United States Patent [19]

Williams

[11] Patent Number: 4,795,375

[45] Date of Patent: Jan. 3, 1989

[54] COMPRESSION AND TORQUE LOAD BEARING CONNECTOR

[76] Inventor: Robert A. Williams, 2721 White Settlement Rd., Fort Worth, Tex. 76107

[21] Appl. No.: 74,336

[22] Filed: Jul. 16, 1987

Related U.S. Application Data

[63] Continuation of Ser. No. 484,586, Apr. 13, 1983, abandoned, which is a continuation of Ser. No. 244,296, Mar. 16, 1981, abandoned.

[51] Int. Cl.[4] ..... H01R 13/64

[52] U.S. Cl. ..... 439/680; 439/905

[58] Field of Search ..... 339/184 R, 184 M, 184 T, 339/186 R, 186 M, 186 T; 439/677–681, 920, 732, 905; 166/65.1

[56] References Cited

U.S. PATENT DOCUMENTS

| | | | |
|---|---|---|---|
| 2,563,762 | 8/1951 | Uline et al. | 439/279 |
| 2,962,688 | 11/1960 | Werner | 439/320 |
| 3,112,974 | 12/1963 | Curtis et al. | 439/292 |
| 3,125,395 | 3/1964 | Swanson | 439/660 |

*Primary Examiner*—Neil Abrams

[57] ABSTRACT

An electrical connector comprising socket and pin contacts located in two shells, respectively which have forward ends adapted to be coupled together for connecting together the socket and pin contacts. The forward end of one shell has a plurality of forward extending tongues adapted to be fitted into melting grooves formed in the other shell when the forward ends of the two shells are coupled together. The tongue and grooves are arranged such that the forward ends of the two shells may be coupled together only when the forward ends of the two shells are in one position relative to each other.

10 Claims, 3 Drawing Sheets

COMPRESSION AND TORQUE LOAD BEARING CONNECTOR

This application is a continuation of U.S. patent application Ser. No. 06/484,586, filed on Apr. 13, 1983, which is a continuation of U.S. patent application Ser. No. 06/244,296, filed on Mar. 16, 1981, both now abandoned.

FIELD OF INVENTION

The present invention relates to electrical connectors.

SUMMARY OF THE INVENTION

It is an object of the present invention to provide a new and useful connector which can withstand a large amount of axial compression and torque.

It is a further object of the invention to provide a connector comprising first and second bodies each of which carries a set of contacts and each of which has a forward end. The forward ends of the two bodies are adapted to be coupled together for coupling together the two sets of contacts. The forward end of one body has tongue means extending forward from a forward surface and the forward end of the other body has groove means extending rearward from a forward surface. When the forward ends of the two bodies are coupled together said two forward surfaces engage each other and said tongue means is located in said groove means.

In a further aspect the tongue means comprises a plurality of tongues and the groove means comprises a plurality of grooves corresponding in number of the number of tongues. The tongues and grooves are arranged such that said forward ends of said first and second bodies may be coupled together only when said forward ends of said first and second bodies are in one position relative to each other.

DESCRIPTION OF THE PREFERRED EMBODIMENT

Figure 1:
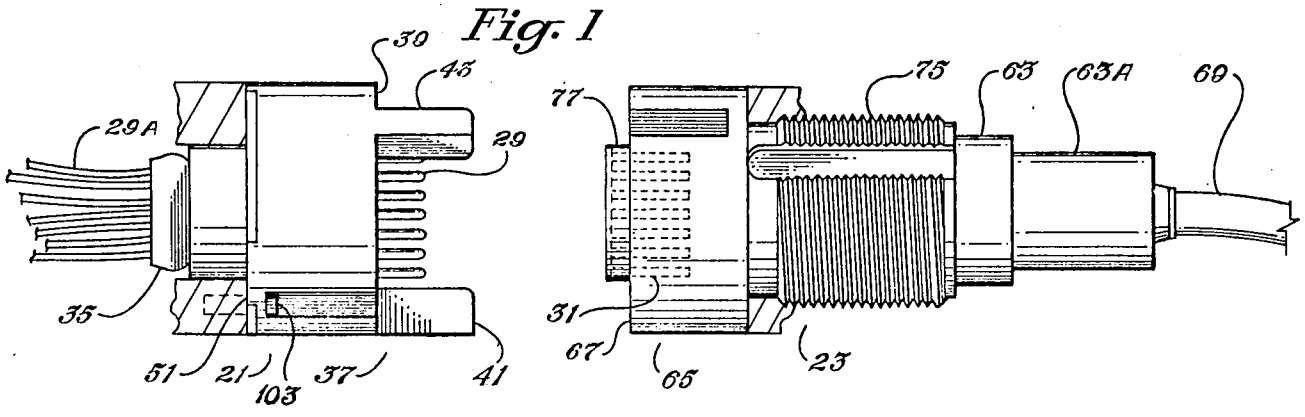
FIG. 1 is a side view of two members which form the connector of the present invention.

Referring now to the drawings, the connector of the present invention comprises two members 21 and 23 comprising shells 25 and 27 which carry electrical pin contacts 29 and socket contacts 31, respectively.

Shell 25 has an opening 33 formed therethrough for receiving a flexible electrically non-conductive grommet 35 which supports the contact pins 29. The grommet 35 is positioned to locate the pins 29 at the forward end 37 of the shell such that they extend beyond the forward surface 39. Electrical leads 29A are connected to the rear ends of the pins 29 and extend through the rear of the grommet 35. Also extending forward of the surface 39 and forward of the contact pins 29 are three tongues 41–43 which are located radically outward of the opening 33. The center lines 42A and 43A of tongues 42 and 43 are located 135° from the centerline 41A of tongue 41. Also formed in the shell 25 are three grooves 47–49 which extend rearward of surface 39 terminating in walls 47A 48A, and 49A which are forward of rear wall 51. Apertures 47B, 48B, and 49B are formed through walls 47A, 48A and 49A and extend through the rear wall 51.

Shell 27 has an opening 61 formed therethrough for receiving an electrically non-conductive wafer 63 which supports the socket contacts 31. The wafer 63 is positioned to locate the front ends of the sockets 31 at the forward end 65 of the shell 27, ahead of the forward surface 67. Electrical leads (not shown) are connected to the rear ends of the sockets 31 and extend through the rear of the wafer 63 and through end position 63A. A cable 69 is coupled to end portion 63A for protecting the electrical leads. Extending rearward of the surface 67 are three grooves 71–73 which are located radically outward of the opening 61. The center lines 72A and 73A of grooves 72 and 73 are located 135° from the center line 71A of groove 71. Threads 75 are formed around the rear portion of the shell an a thin annular wall 77 extends forward of surface 67.

Figure 6:
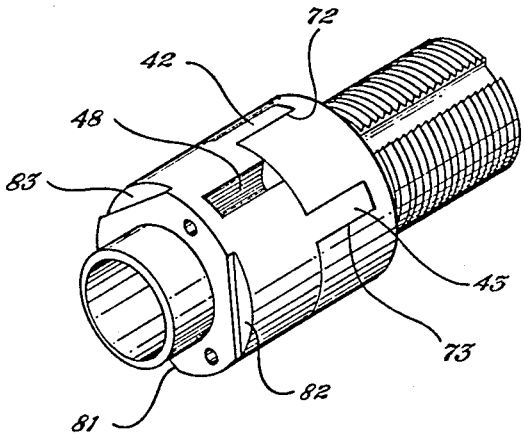
FIG. 6 illustrates the two shells of FIGS. 1, 4, and 5 coupled together.
Figure 7:
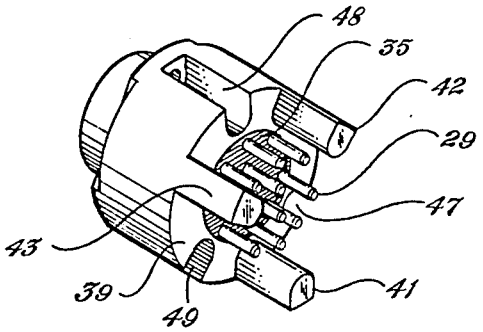
FIG. 7 is a perspective view of the member on the left of FIG. 1.
Figure 8:
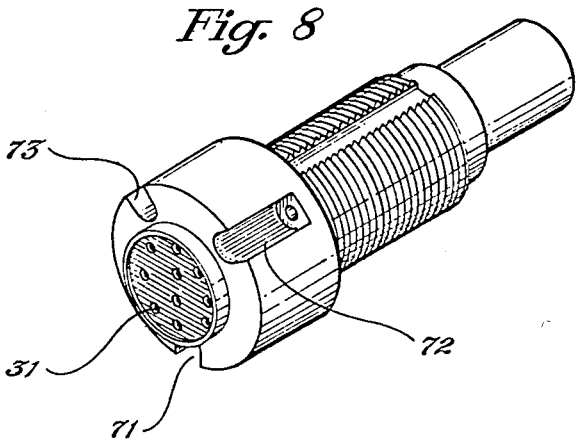
FIG. 8 is a perspective view of the member on the right of FIG. 1.

The tongues 41, 42, 43 are formed to fit in grooves 71, 72, 73, respectively when they are in alignment to couple the forward ends of the shells 25 and 27 together with the forward surfaces 39 and 67 engaging each other as shown in FIG. 6 . When the forward ends of the shells 25 and 27 are coupled together, annular wall 77 fits into the forward enlarged portion 33A of opening 33 and the contact pins 29 fit into and engage the sockets 31, respectively to electrically connect the contact pins 29 and the sockets 31. When coupling the forward ends of the shells 25 and 27 together, the tongues 41–43 will fit into grooves 71-73 respectively before the pins 29 and the sockets 31 engage each other to insure proper alignment of the pins 29 with the sockets 31 whereby the pins 29 will properly fit into the sockets 31.

Figure 3:
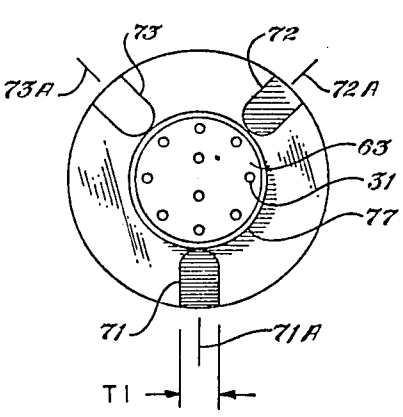
FIG. 3 is a front view of the member on the right of FIG. 1.
Figure 2:
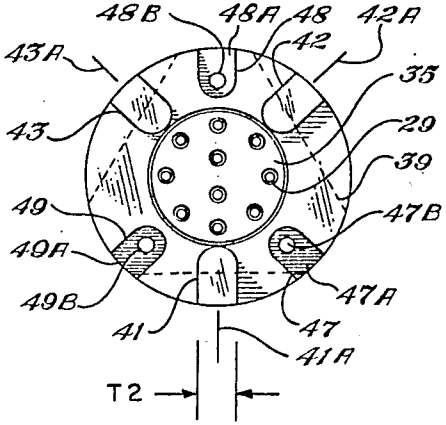
FIG. 2 is a front view of the member on the left of FIG. 1.
Figure 4:
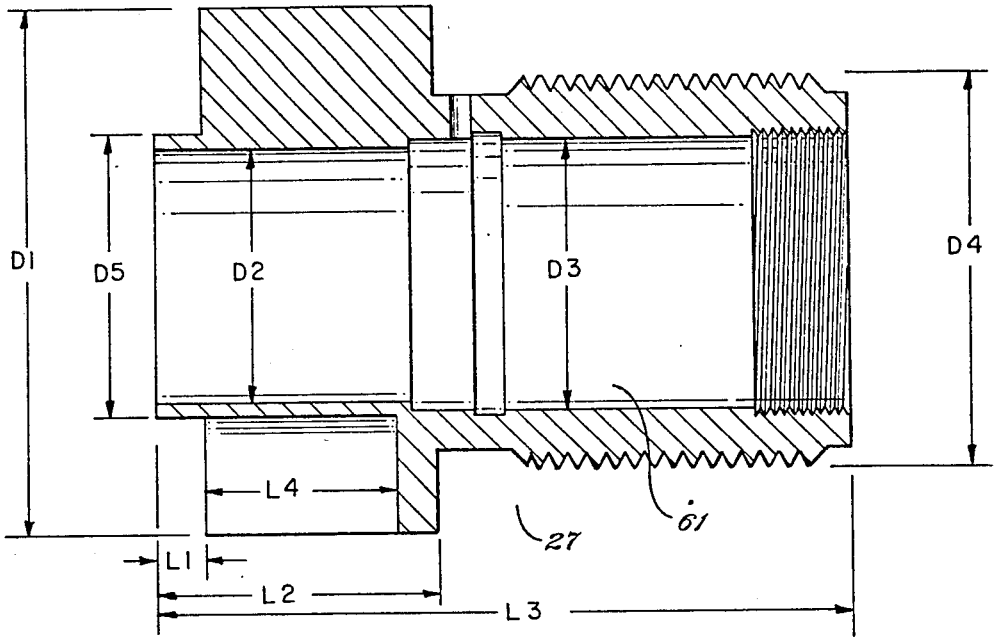
FIG. 4 is a cross-sectional view of the shell of the member on the right of FIG. 1.
Figure 5:
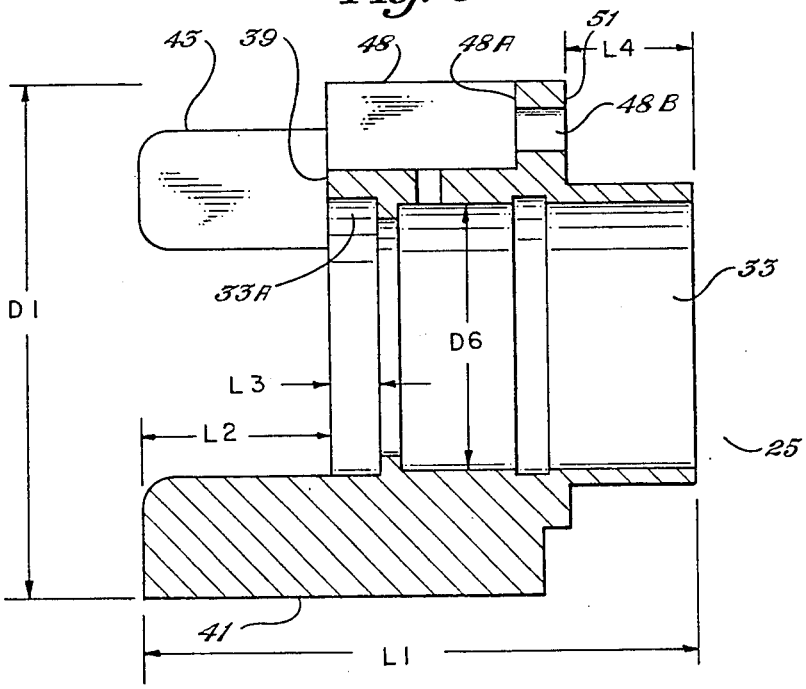
FIG. 5 is a cross-sectional view of the shell of the member on the left of FIG. 1.

In one embodiment the shells 25 and 27 each is formed of aluminum. The maximum outside diameter D1 of each of shells 25 and 27 is 1.6 inches. Referring to FIG. 4, D2 is equal to about 0.775 of an inch, D3 is equal to about 0.832 of an inch, D4 is equal to about 1.248 inches, D5 is equal to about 0.870 of an inch. L1 is equal to 0.150 of an inch, L2 is equal to 0.900 of an inch, L3 is equal to 2.250 inches, and L4 is equal to 0.620 of an inch. Referring to FIG. 3, T1 is equal to about 0.250 of an inch. Each of grooves 71, 72, and 73 has the same dimensions. Referring to FIG. 5, D6 is equal to about 0.8355 of an inch, L1 is equal to 1.750 inches, L2 is equal to 0.600 of an inch, L3 is equal to 0.150 of an inch, and L4 is equal to 0.400 of an inch. Referring to FIG. 2, T2 is equal to about 0.245 of an inch.

Due to the structure of the connector of the present invention, it will withstand high axial compression loads and high torque loads. The tongues 41–43 and grooves 71–73 enable the connector to withstand high torsional loads. The connector is particularly suited for use in a downhole testing while drilling tool. In such a tool, the electronic equipment is located next to the drill bit where the axial compression and torque loads are very high. A plurality of electronic modules are located in tubes which in turn are located in the drill stem. Member 21 is connected to one tube and member 23 connected to an adjacent tube. The electronic modules are located in the tube to which member 23 is connected and in turn are electrically connected to the leads of cable 69. Leads 29A of member 21 may be connected to the leads of a similar member 21 connected to the other end of its tube or to electronic modules located in the tube. The electrical components of the adjacent tubes are connected together y coupling together the forward ends of shells 25 and 27 to couple together contacts 29 and 31. Member 23 is connected to its tube by screwing threads 75 into mating female threads formed in the end of the tube. Member 21 is connected to its tube by inserting its rear cylindrical portion 21A into the tube until the end of the tube butts up against the rear wall 51. Bolts 103 are inserted into apertures 47B, 48B, and 49B and screwed into mating holes formed in the end of the tube. Rear wall 51 has three flat slots 81–83 machines out as shown in FIGS. 1, 2, 5, 6, and 7. The end of the tube to which member 21 is connected has its central portion machined out to form three extending tabs which fit into the slots 81–83 to remove the torsion load from the mounting bolts which extend through apertures 47B, 48B, and 49B. Thus as can be understood, the shells 25 and 27 of the connector from part of the structure of adjacent tubes and bear the torsional and compression loads between the tubes occasioned as the drill stem is rotated and moves up and down.

I claim:

1. A connector comprising:

a first body having a central opening formed therethrough, said first body having a forward end and a rear end and being cylindrical in shape between said forward and rear ends, said first body having a forward surface formed at its forward end, means carrying a first set of a plurality of electrical contacts located in said opening of said first body, said first set of electrical contacts being located at said forward end of said first body, a second body having a central opening formed therethrough, said second body having a forward portion with a forward end and a rearward portion with a rear end, said second body having a forward surface formed at its forward end, means carrying a second set of a plurality of electrical contacts located in said opening of said second body, said second set of electrical contacts being located at said forward end of said second body, said first body having tongue means extending forward from its forward surface, said second body having groove means extending rearward from its forward surface, said groove means being formed in the exterior surface of said second body, said first and second bodies being adapted to be coupled together with said forward surfaces engaging each other and with said tongue means located in said groove means to withstand a large amount of axial compression and a large amount of torque, said first and second set of contacts engaging each other when said first and second bodies are coupled together, means formed in said rearward portion of second body for connecting said second body to a tubular member, and at least one slot formed in the outer surface of said first body and extending rearward from its forward end toward its rear end to a wall having a forward facing surface, an opening extending through said wall between said forward facing surface and said rear end of said first body wherein said slot and said opening extending through said wall may be used as means for connecting said first body to a tubular member.

2. The connector of claim 1, wherein:

said tongue means comprises a plurality of tongues, said groove means comprises a plurality of grooves corresponding in number to the number of said tongues, said tongues and grooves being arranged such that said first and second bodies may be coupled together only when said first and second bodies are in one position relative to each other, when said first and second bodies are coupled together said forward surface of said first body between its tongues engages said forward surface of said second body between its grooves, said first body has a plurality of said slots formed in the outer surface thereof, each of said slots extends rearward from said forward end of said first body at a position between a different pair of adjacent tongues.

3. A connector comprising:

a first body having a central opening formed therethrough, said first body having a forward end and a rear end and being cylindrical in shape between said forward and rear ends, said first body having a forward surface formed at its forward end, means carrying a first set of a plurality of electrical contacts located in said opening of said first body, said first set of electrical contacts being located at said forward end of said first body, a second body having a central opening formed therethrough, said second body having a forward portion with a forward end and a rearward portion with a rear end said forward portion of said second body being cylindrical in shape and having a diameter greater than the maximum cross-sectional dimension of said rearward portion of said second body, the diameters of said cylindrical shaped first body and of said forward portion of said second body being substantially the same, said second body having a forward surface formed at its forward end, means carrying a second set of a plurality of electrical contacts located in said opening of said second body, said second set of electrical contacts being located at said forward end of said second body, said first body having tongue means extending forward from its forward surface, said second body having groove means extending rearward from its forward surface, said groove means being formed in the exterior surface of said second body, said first and second bodies being adapted to be coupled together with said forward surfaces engaging each other and with said tongue means located in said groove means to withstand a large amount of axial compression and a large amount of torque, said first and second set of contacts engaging each other when said first and second bodies are coupled together, the outside surface of said tongue means being arcuate in shape and a forward continuation of the cylindrical shaped outside surface of said first body such that the radius of the outside surface of said tongue means is equal to the radius of said cylindrical shaped first body, means formed in said rearward portion of second body for connecting said second body to a tubular member, at least one slot formed in the outer surface of said first body and extending rearward from its forward end toward its rear end to a wall having a forward facing surface, an opening extending through said wall between said forward facing surface and said rear end of said first body, wherein said slot and said opening extending through said wall may be used as means for connecting said first body to a tubular member.

4. The connector of claim 3, wherein:

said tongue means comprises a plurality of tongues, said groove means comprises a plurality of grooves corresponding in number to the number of said tongues, said tongues and grooves being arranged such that said first and second bodies may be coupled together only when said first and second bodies are in one position relative to each other, when said first and second bodies are coupled together said forward surface of said first body between its tongues engages said forward surface of said second body between its grooves, said first body has a plurality of said slots formed in the outer surface thereof, each of said slots extends rearward from said forward end of said first body at a position between a different pair of adjacent tongues.

5. A connector comprising:

a first body having an opening formed therethrough, said first body having a forward end and a rear end, said first body having a forward surface formed at its forward end, means carrying a first set of electrical contacts located in said opening of said first body, said first set of electrical contacts being located at said forward end of said first body, a second body having an opening formed therethrough, through, said second body having a forward portion with a forward end and a rearward portion with a rear end, said second body having a forward surface formed at its forward end, means carrying a second set of electrical contacts located in said opening of said second body, said second set of electrical contacts being located at said forward end of said second body, said first body having tongue means extending forward from its forward surface, said tongue means forward of said forward surface of said first body being separate and apart from any other structure of said first body, said second body having groove means extending rearward from its forward surface, said groove means being formed in the exterior surface of said second body such that wall structure is located between said groove means and said opening of said second body, said second body at the outer periphery of its forward end has no structure extending forward of its forward surface, said first and second bodies being adapted to be coupled together with said forward surfaces engaging each other and with said tongue means located in said groove means, said first and second set of contacts engaging each other when said first and second bodies are coupled together, means formed in said rearward portion of second body for connecting said second body to a tubular member, at least one slot formed in the outer surface of said first body and extending rearward from its forward end toward its rear end to a wall having a forward facing surface, an opening extending through said wall between said forward facing surface and said rear end of said first body, wherein said slot and said opening extending through said wall may be used as means for connecting said first body to a tubular member.

6. The connector of claim 5, wherein:

said tongue means comprises a plurality of tongues, said groove means comprises a plurality of grooves corresponding in number to the number of said tongues, said tongues and grooves being arranged such that said first and second bodies may be coupled together only when said first and second bodies are in one position relative to each other and when said tongues are in said grooves, said first and second bodies are unable to rotate relative to each other, said first body has a plurality of said slots formed in the outer surface thereof, each of said slots extends rearward from said forward end of said first body at a position between a different pair of adjacent tongues.

7. A connector comprising:

a first body formed of metal and having a central opening formed therethrough, said first body having a forward end and a rear end and being cylindrical in shape between said forward and rear ends, said first body having a forward surface formed at its forward end, means carrying a first set of plurality of electrical contacts located in said opening of said first body, said first set of electrical contacts being located at said forward end of said first body, a second body formed of metal and having a central opening formed therethrough, said second body having a forward portion with a forward end and a rearward portion with rear end, said forward portion of said second body being cylindrical in shape and having a diameter greater than the maximum cross-sectional dimension of said rearward portion of said second body, the diameters of said cylindrical shaped first body and of said forward portion of said second body being substantially the same, said second body having a forward surface formed at its rear end, means carrying a second set of a plurality of electrical contacts located in said opening of said second body, said second set of electrical contacts being located at said forward end of said second body, said first body having a plurality of angularly spaced apart tongues extending forward from its forward surface, said plurality of tongues forward of said forward surface of said first body being free of interconnecting structure, said second body having a plurality of angularly spaced apart grooves extending rearward of its forward surface, said grooves being formed in the exterior surface of said second body such that wall structure is located between said grooves and said central opening of said second body, said plurality of grooves corresponding in number to the number of said plurality of tongues, said first and second bodies being adapted to be coupled together with said tongues located in said grooves and with said forward surface of said first body between its tongues engaging said forward surface of said second body between its grooves to withstand a large amount of axial compression and a large amount of torque, said first and second set of contacts engaging each other when said first and second bodies are coupled together, the outside surface of said tongues being arcuate in shape and a forward continuation of the cylindrical shaped outside surface of said first body such that the radius of the outside surface of said tongues is equal to the radius of said cylindrical shaped first body, means formed in said rearward portion of second body for connecting said second body to a tubular member, a plurality of slots formed in the outer surface of said first body, each of said slots extends rearward from said forward end of said first body at a position between a different pair of adjacent tongues toward said rear end of said first body to a wall having a forward facing surface, an opening extending through each of said walls between its forward facing surface and said rear end of said first body, wherein said slots and said openings extending through said walls may be used as means for connecting said first body to a tubular member.

8. The connector of claim 7, wherein:

said plurality of tongues and said plurality of grooves are arranged such that said first and second bodies may be coupled together only when said first and second bodies are in one position relative to each other and when said tongues are in said grooves, said first and second bodies are unable to rotate relative to each other.

9. The connector of claim 8, wherein:

in a plane perpendicular to the axis of said first body, the dimension of each of said tongues along a radial line is greater than its dimension along a line perpendicular to the radial line.

10. The connector of claim 7, wherein:

said grooves are formed in the exterior surface of said second body such that wall structure is located between the entire length of each of said grooves and said central opening of said second body.

* * * * *